US005531436A

United States Patent [19]

Ohyama et al.

[11] Patent Number: 5,531,436

[45] Date of Patent: Jul. 2, 1996

[54] SHEET TRANSPORT APPARATUS WITH MINIMIZED LOAD BETWEEN ELECTROSTATIC GENERATING DEVICE AND TRANSPORT BELT

[75] Inventors: Kazuo Ohyama, Mitaka; Shigeyoshi Onoda; Haruo Uchida, both of Yokohama, all of Japan

[73] Assignee: Canon Kabushiki Kaisha, Tokyo, Japan

[21] Appl. No.: 338,136

[22] Filed: Nov. 9, 1994

[30] Foreign Application Priority Data

Nov. 16, 1993 [JP] Japan ..... 5-309853

[51] Int. Cl.[6] ..... B65H 5/02

[52] U.S. Cl. ..... 271/275; 271/193; 198/691; 346/134; 347/101

[58] Field of Search ..... 271/275, 193, 271/18.1; 101/DIG. 37; 346/134; 347/101; 198/691

[56] References Cited

U.S. PATENT DOCUMENTS

| | | | |
|---|---|---|---|
| 3,690,646 | 9/1972 | Kolibus | 271/193 |
| 3,981,498 | 9/1976 | Fletcher | 271/193 |
| 4,244,465 | 1/1981 | Hishikawa et al. | 198/691 |
| 4,526,357 | 7/1985 | Kuehnle et al. | 271/193 |
| 4,856,769 | 8/1989 | Andrew et al. | 271/193 |
| 4,864,461 | 9/1989 | Kasahara | 271/193 |

FOREIGN PATENT DOCUMENTS

| | | | |
|---|---|---|---|
| 3-152034 | 6/1991 | Japan | 271/193 |
| 5-270677 | 10/1993 | Japan | 271/18.1 |

*Primary Examiner*—H. Grant Skaggs
*Attorney, Agent, or Firm*—Fitzpatrick, Cella, Harper & Scinto

[57] ABSTRACT

A sheet transport apparatus includes a device for generating an electrostatic attraction force for attracting a sheet member to a surface of a transport belt disposed close to another surface of the transport belt opposite to the surface that contacts the sheet member. The apparatus is arranged to reduce a drive load on the transport belt caused by the electrostatic attraction force. To achieve this effect, at least one of a surface of the electrostatic attraction force generating device contacting the transport belt and a surface of the transport belt contacting the electrostatic attraction force generating device is roughened. Alternatively, an electrostatic attraction force generated at at least one particular portion of the transport belt by the electrostatic attraction force generating device is smaller than an electrostatic attraction force generated at another portion of the transport belt.

34 Claims, 13 Drawing Sheets

SHEET TRANSPORT APPARATUS WITH MINIMIZED LOAD BETWEEN ELECTROSTATIC GENERATING DEVICE AND TRANSPORT BELT

BACKGROUND OF THE INVENTION

1. Field of the Invention

This invention relates to a sheet transport apparatus for use in a printer, a facsimile machine and, more particularly, an ink jet type image forming apparatus.

2. Description of the Related Art

An ordinary, conventional ink jet recording apparatus will be described with reference to FIGS. 12 and 13. FIG. 12 shows a recording head 101 for recording by ejecting ink, a carriage 102 capable of moving while supporting the recording head 101, guide rails 103 for supporting and guiding the carriage 102, a motor 104 for driving the carriage 102, a pulley 105 directly connected to the motor 104, a follower pulley 106 opposite to the pulley 105, a wire 107 wrapped around the pulley 105 and the follower pulley 106 to transmit motive power of the motor 104 to the carriage 102, a recording medium 109, such as paper, a paper feed motor 110 for moving the recording medium 109, a cap 112 for protecting nozzles from drying and other problems, a transport roller 115 for transporting the recording medium 109, a pressing roller 116 for pressing the recording medium 109 against the roller 115 by using an urging means (not shown), and a non-recording ejection box 117 positioned between the cap 112 and the recording medium 109 and used for receiving ejection of ink droplets from the recording head 101 other than ejection for recording. The carriage 102 is movable in the directions of arrows 113, and the roller 115 is rotated in the direction of arrow 114.

When recording is performed by this apparatus, the recording head 101, having the nozzles protected by the cap 112, is moved away from the cap 112, and the motive power from the motor 104 is transmitted to the wire 107 wrapped around the pulley 105 and the follower pulley 106. The recording head 101 is thereby moved together with the carriage 103 parallel to the recording medium 109 and is moved through a predetermined range in the vicinity of the recording medium 109 to scan the same. Thereafter, the direction of movement of the recording head 101 is reversed and the recording head 101 is moved toward the cap 112. During this scan, the recording head 101 ejects ink droplets at predetermined positions to perform recording while traveling back and forth in the directions of arrows 113. Each time this cycle of scanning of the recording head 101 on the recording medium 109 is completed, the recording medium 109 is fed through a predetermined distance along the direction of arrow 114 by the paper feed motor 110 and the roller 115. These operations are repeated to perform recording.

However, the above-described conventional recording apparatus has drawbacks described below. In the example of the conventional apparatus shown in FIG. 12, recording cannot be performed on an end portion of the recording medium 109 located between the nip of the transport and pressing rollers 115 and 116 and the nozzle at the end of the head closer to the pressing roller 116 by a final scanning stroke, because there is no means for accurately feeding this portion of the recording medium 109 to the recording position. Therefore, a margin of a recorded page corresponding to such a trailing end portion of the recording medium 109 is large and a suitable image size cannot be obtained.

FIG. 13 illustrates the size of the margin. In particular, if the recording medium 109 has a certain large size such as A1 or A0 size, then the pressing roller 116, the length of which is correspondingly large, must have an increased diameter in order to maintain its desired strength, resulting in a further increase in the size of the margin. If a pair of rollers are provided on the downstream side of the recording medium 109, a similar margin is formed at the leading end of the recording medium 109.

A recording apparatus having a similar construction and having pairs of rollers respectively provided on the upstream and downstream sides of the recording medium 109 facing the recording head 101 is also known. In this apparatus, if the feed rates of the pairs of rollers are equal to each other, there is a possibility of the recording medium bending between the pairs of rollers to contact the recording head when feed errors are accumulated. To prevent occurrence of such a phenomenon, the feed rate of the downstream rollers is set so as to be a significant percentage larger than that of the upstream rollers. In this arrangement, however, the recording medium 109 is fed only by the downstream rollers after the trailing end of the recording medium 109 has passed the upstream rollers. Unless the feed rate of the downstream rollers is changed at this time, the accuracy of image formation is reduced. A complicated feed rate control is therefore required for this arrangement.

Water is ordinarily used as a main solvent for recording ink. If an image is recorded at a high density, a large amount of water is applied to the recording medium 109 to permeate into the same, thereby causing the recording medium 109 to swell and increase in size. As a result, a cockling or warping phenomenon occurs such that the recording medium 109 is cockled in the recording area. If the height of cockles thereby formed is increased, it is possible that the recording medium 109 will contact the head 101 to cause a disturbance in the resulting image or that clogging will occur in the nozzles of the recording head 101.

SUMMARY OF THE INVENTION

In view of the above-described technical problems of the conventional sheet transport apparatus having rollers, an object of the present invention is to provide a sheet transport apparatus in which the amount of deformation of a recording medium sheet can be limited to a small value.

Another object of the present invention is to provide a sheet transport apparatus in which a drive load caused upon a transport belt due to an electrostatic attraction force between the transport belt and an electrostatic attraction force generation means can be markedly reduced.

To achieve these objects, according to one aspect of the present invention, there is provided a sheet transport apparatus comprising a transport belt for transporting a sheet member by contacting the sheet member, and electrostatic attraction force generation means for generating an electrostatic force for attracting the sheet member to a surface of the transport belt, the electrostatic attraction force generation means being disposed close to another surface of the transport belt opposite to the surface brought into contact with the sheet member. At least one of a surface of the electrostatic attraction force generation means contacting the transport belt and a surface of the transport belt contacting the electrostatic attraction force generation means is roughened.

According to another aspect of the present invention, there is provided a sheet transport apparatus comprising a transport belt for transporting a sheet member by contacting the sheet member, and electrostatic attraction force generation means for generating an electrostatic force for attracting the sheet member to a surface of the transport belt. The electrostatic attraction force generation means is disposed close to another surface of the transport belt opposite to the surface to be brought into contact with the sheet member. An electrostatic attraction force generated at at least one particular portion of the transport belt, of the electrostatic attraction force generated on the transport belt by the electrostatic attraction force generation means, is smaller than an electrostatic attraction force generated at the other portion of the transport belt.

According to yet another aspect of the present invention, there is provided a sheet transport apparatus comprising a transport belt, an electrostatic attraction force generation means, and reducing means. The transport belt transports a sheet member and has an inner surface and an outer surface. The sheet member contacts the outer surface. The electrostatic attraction force generation means generates an electrostatic force for attracting the sheet member to the outer surface of the transport belt. The electrostatic attraction force generation means is disposed adjacent the inner surface of the transport belt. The reducing means reduces a load between the inner surface of the transport belt and the electrostatic attraction force generation means.

These and other objects and features of the present invention will be come apparent from the following detailed description of the invention.

DESCRIPTION OF THE PREFERRED EMBODIMENTS

Figure 1:
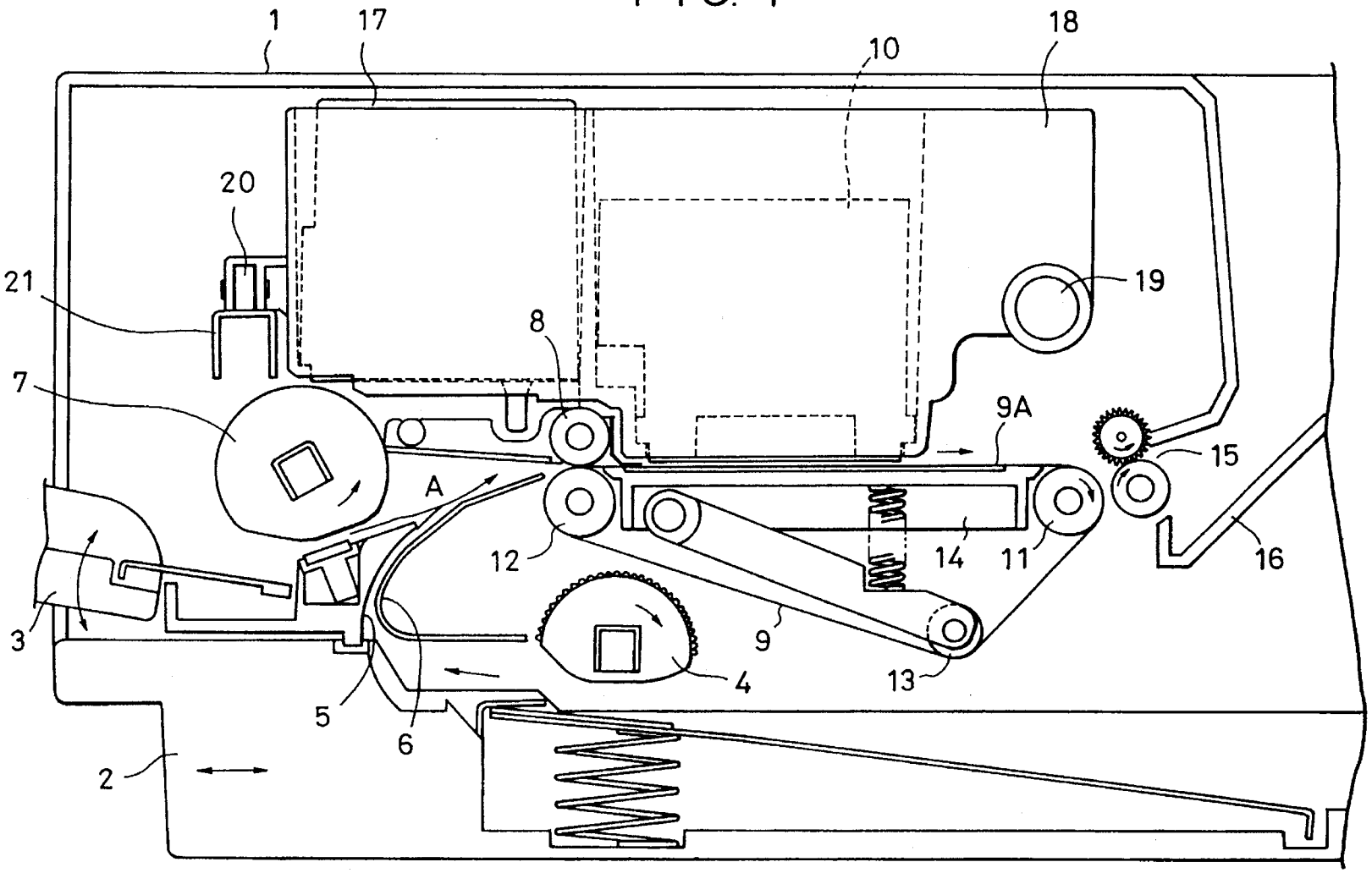
FIG. 1 is a schematic longitudinal sectional side view of the overall construction of an ink jet printer to which the present invention is applied.

FIG. 1 shows the overall construction of an ink jet printer as an example of an apparatus to which the present invention is applied.

The overall construction of this printer will be described along the flow of sheet members.

This printer has a feed cassette 2 detachably set in a printer body 1, and a retractable feed tray 3 provided on a side portion of the printer body 1. Sheet members are selectively fed from one of these feed units.

Sheet members stacked in the feed cassette 2 are fed out one after another from the uppermost one by a feed roller 4 which is rotated clockwise. Each sheet fed out by the feed roller 4 travels in the direction of arrow A while being guided by guides 5 and 6.

Sheet members stacked on the feed tray 3 are fed out one after another from the uppermost one by a feed roller 7 which is rotated counterclockwise. Each sheet fed out by the feed roller 7 travels in the direction of arrow A while being guided by guides 5 and 6.

Thereafter, the sheet member is transported onto an endless transport belt 9, which is rotated clockwise, by a transport roller 8 rotating counterclockwise. The sheet member is carried on the transport belt 9 to be transported to a position below an ink jet type printing head 10. Predetermined printing is performed on the sheet surface with inks selectively ejected from a plurality of nozzles of the printing head 10.

The endless transport belt 9 is formed of a sheet of a synthetic resin (e.g., polycarbonate, polyethylene or the like) having a thickness of about 0.1 to 0.2 mm. The endless transport belt 9 is wrapped around a driving roller 11 disposed on the downstream side of the printing head 10 and a follower roller 12 disposed on the upstream side of the printing head 10, and a suitable tension is caused in the belt 9 by a tension roller 13.

The endless transport belt 9 thus formed has a horizontal portion 9A between a center of the driving roller 11 and a center of the follower roller 12. Each sheet member is transported by the horizontal portion 9A. The transport roller 8 is disposed so as to face the follower roller 12 and contacts the transport belt 9 at a predetermined pressure.

The endless transport belt 9, rotated clockwise by the rotational driving of the driving roller 11, is charged by an electrostatic attraction force generation unit (electrostatic attraction force generation means) 14 provided under the horizontal portion 9A so as to be ready to attract each sheet member. Therefore, the sheet member placed on the transport belt 9 by the transport roller 8 is transported in a state of being attracted by an electrostatic force to the transport belt 9.

Since the sheet member transported by the transport belt 9 is electrostatically attracted to the transport belt 9 in this manner, floating of the sheet member on the printing head 10 side is prevented during transport, and it is therefore possible to limit cockling due to ink ejected from the printing head 10.

After the completion of printing on the sheet member by the printing head 10, the sheet member is transported to the pair of downstream discharge rollers 15 by the transport belt 9 and is discharged onto a discharge tray 16 in a slanted attitude by the pair of discharge rollers 15.

The printing head 10 and an ink tank 17 for supplying ink to the printing head 10 are held on a main scanning carriage 18 which can be moved in a direction perpendicular to the sheet transporting direction (perpendicular to paper).

The main scanning carriage 18 is moved in a direction perpendicular to the sheet transporting direction along a rail 19 in the form of a round rod fitted in the main scanning carriage 18 and along a rail 21 which guides rollers 20 provided on the main scanning carriage 18.

The printing operation of the printing head 10 will not be described in this specification.

Figure 2:
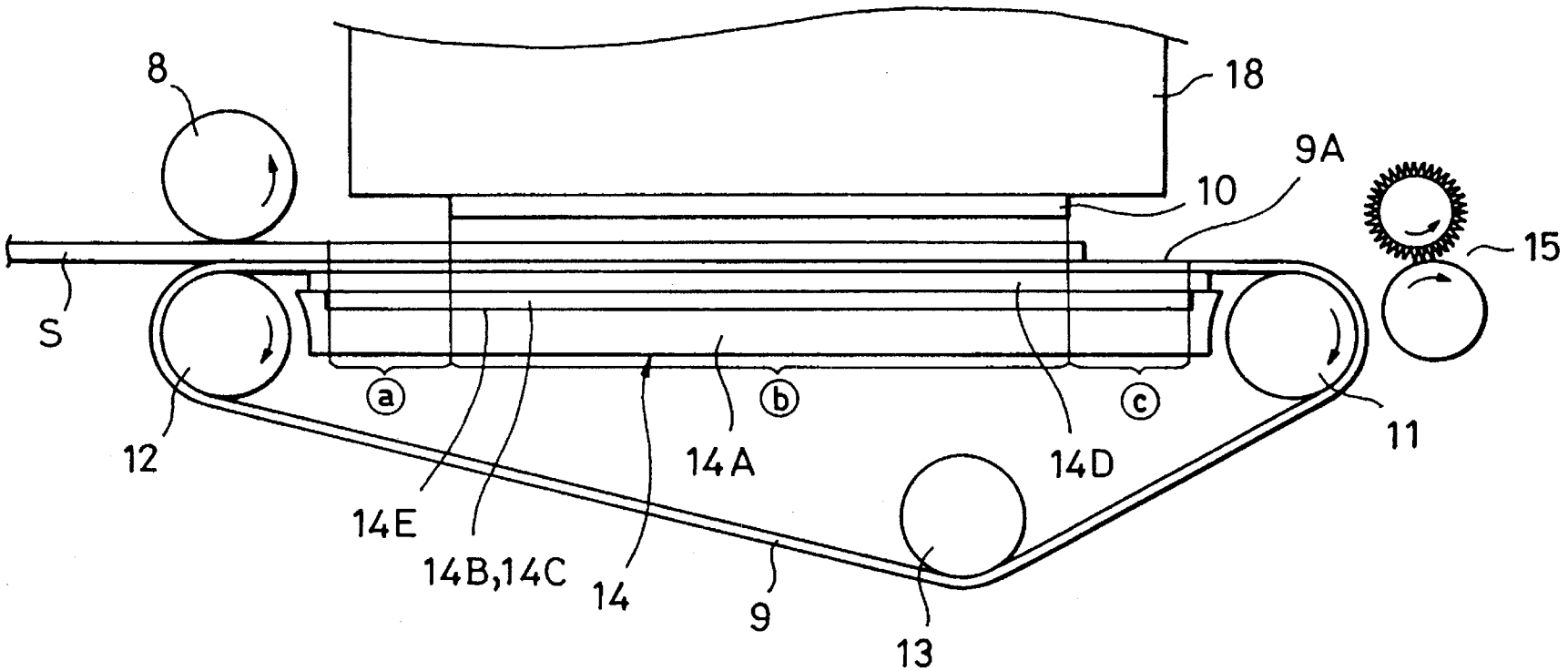
FIG. 2 is a schematic longitudinal sectional side view of the overall construction of a sheet transport apparatus provided in the printer shown in FIG. 1.
Figure 3:
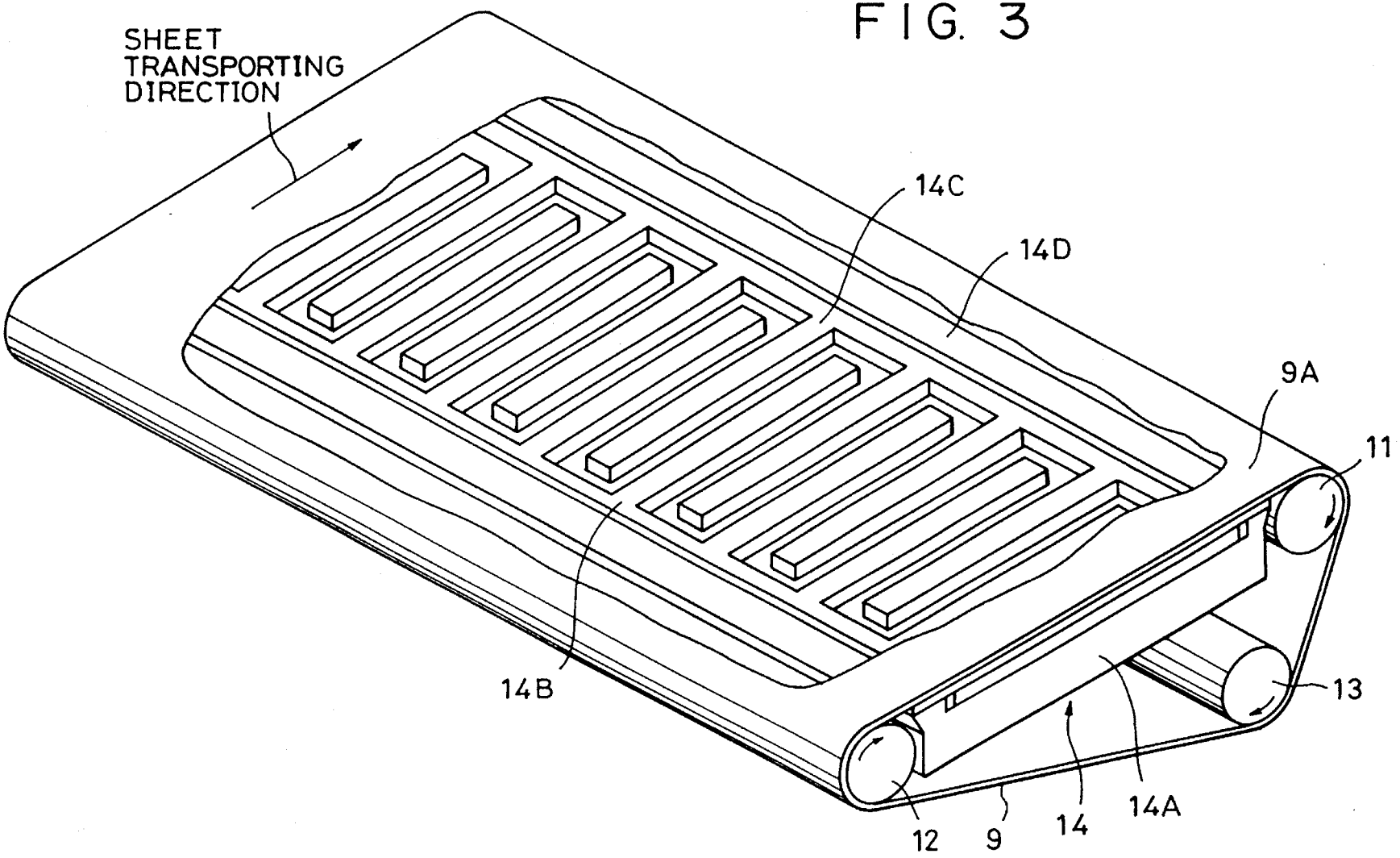
FIG. 3 is a partially-cutaway perspective view of the overall construction of the sheet transport apparatus shown in FIG. 2.

FIGS. 2 and 3 show the construction of the electrostatic attraction force generation unit 14 for electrostatically attracting the transport belt 9.

The electrostatic attraction force generation unit 14 has an electrode base 14A, a comb-like electrode plate 14B, a comb-like earth (ground) plate 14C, and an electrode protection member 14D. The comb-like electrode plate 14B and the comb-like earth plate 14C are fixed by an adhesive or the like in a recess 14E formed in an upper surface of the electrode base 14A in a state of meshing with each other with a certain spacing maintained therebetween. Tooth-like portions of the electrode plate 14B and the earth plate 14C extend along the sheet transporting direction.

The electrode protection member 14D is formed of a sheet of a synthetic resin (e.g., polycarbonate, polyethylene or the like) having a thickness of about 0.1 to 0.2 mm, and is fixed on the electrode base 14A by an adhesive or the like so as to cover the electrode plate 14B and the earth plate 14C.

The electrode protection member 14D contacts the endless belt 9 and also contacts the electrode plate 14B and the earth plate 14C. The surfaces of the electrode protection member 14D and the transport belt 9 are smoothly formed.

When a predetermined voltage (e.g., 0.5 to 10 kV) is applied to the electrode plate 14B of the electrostatic attraction force generation unit 14, the transport belt 9 is charged through the electrode protection member 14D to generate an electrostatic attraction force applied to the horizontal portion 9A of the transport belt 9. The earth plate 14C is grounded. Alternatively, a voltage having a polarity opposite to that of the voltage applied to the electrode plate 14B may be applied to the earth plate 14C. This electrostatic attraction force is generated uniformly in magnitude through an upstream end region a located on the upstream side of the printing head 10, a printing region b facing the printing head 10, and a downstream region c located on the downstream side of the printing head 10.

The upstream region a, where the electrostatic attraction force is generated, is provided to prevent slippage between the sheet member S and the transport belt 9 through a length of transport passage from the transport roller 8 disposed in such a position as to avoid interference with the main scanning carriage 18 to the printing head 10.

The downstream region c, where the electrostatic attraction force is generated, is provided to enable the sheet member S to smoothly enter the nip between the pair of discharge rollers 15 without floating.

The above-described sheet transport apparatus (composed of the transport belt 9 and the electrostatic attraction force generation unit 14 and other components) provided in the printer basically entails a problem described below. That is, when an electrostatic attraction force is generated on the transport belt 9 by the electrostatic attraction force generation unit 14, an electrostatic attraction force is also caused between the transport belt 9 and the electrode protection member 14D. The transport belt 9 rotated clockwise is thereby attracted to the electrode protection member 14D to cause a drive load (frictional resistance) on the transport belt 9. This problem is negligible when the drive load is small.

However, if both the electrode protection member 14D and the transport belt 9 are formed so as to contact each other by their smooth surfaces, they closely contact each other by an electrostatic attraction force, so that the drive load on the transport belt 9 is considerably large.

In the case where an electrostatic attraction force is also generated at the upstream region a and the downstream region c at the same magnitude as that generated at the printing region b, the total electrostatic attraction force generated between the transport belt 9 and the electrode protection member 14D through the entire length of the belt charging unit 14 is substantially large. Accordingly, the drive load on the transport belt 9 in this case is considerably large. Essentially, at the upstream or downstream region a or c, a small electrostatic attraction force enough to prevent the sheet member S from slipping or floating will suffice.

If the drive load on the transport belt 9 is considerably increased for the above-described reason, it is necessary to drive the transport belt 9 by a motor having a large torque matching the drive load. Also, a slippage may occur between the driving roller 11 and the transport belt 9 to reduce the accuracy with which the sheet member S is fed.

According to the present invention, therefore, an arrangement described below is adopted.

Figure 4:
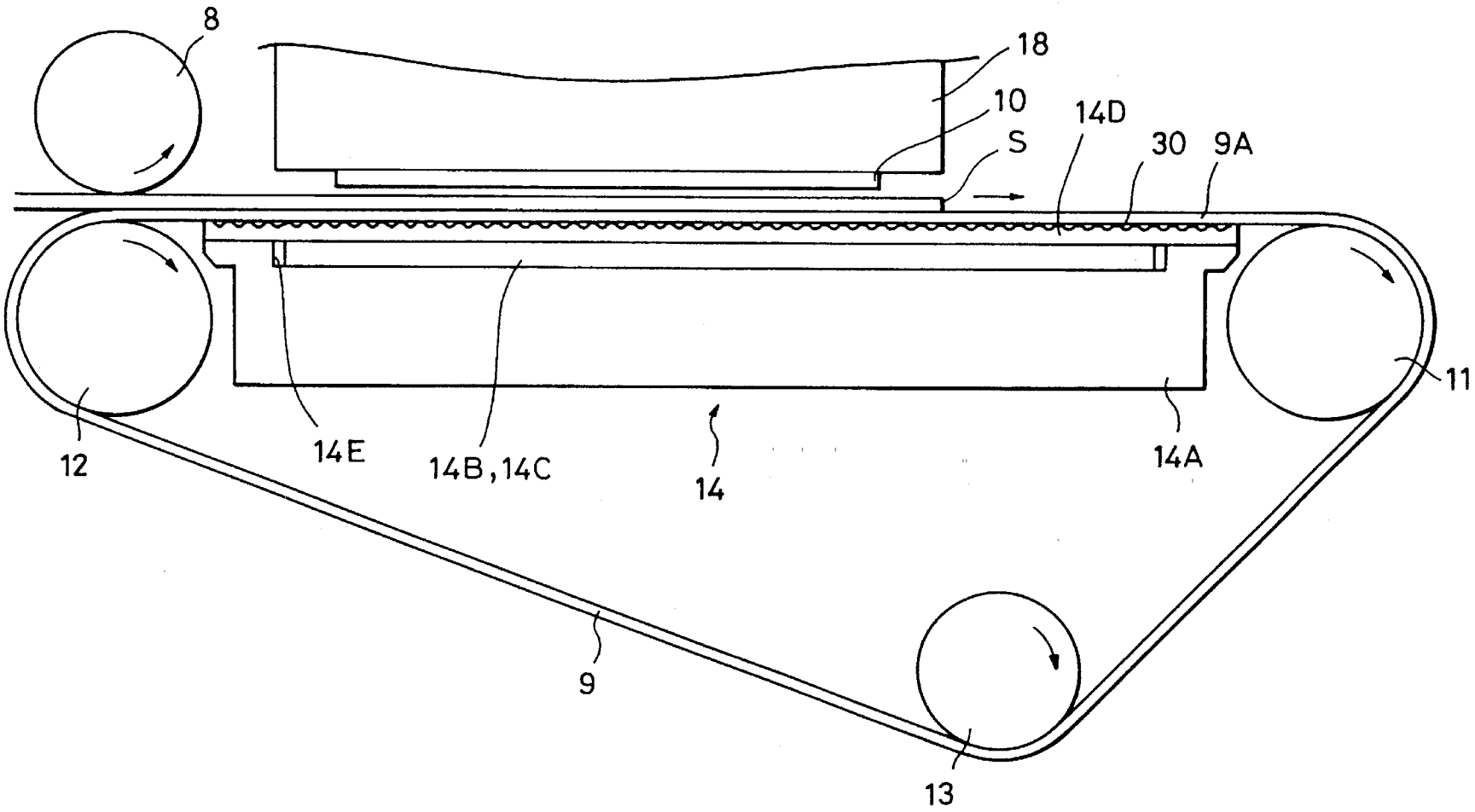
FIG. 4 is a longitudinal sectional side view of the overall construction of a sheet transport apparatus in accordance with a first embodiment of the present invention.

In the sheet transport apparatus of this embodiment, as shown in FIG. 4, the entire upper surface of the electrode protection member 14D in contact with the transport belt 9 is finely roughened as indicated at 30 in FIG. 4 to form a fine roughness pattern in which the average distance between peaks is several microns to several tens of microns. The fine roughness pattern 30 is a crease-like pattern in which grooves or projections extend generally perpendicularly to the sheet transporting direction, a diagonal pattern, or the like. The fine roughness pattern 30 is formed, for example, by etching, sand blasting or embossing. The difference in level between peaks and troughs in the roughness pattern is several microns to several tens of microns.

Figure 5:
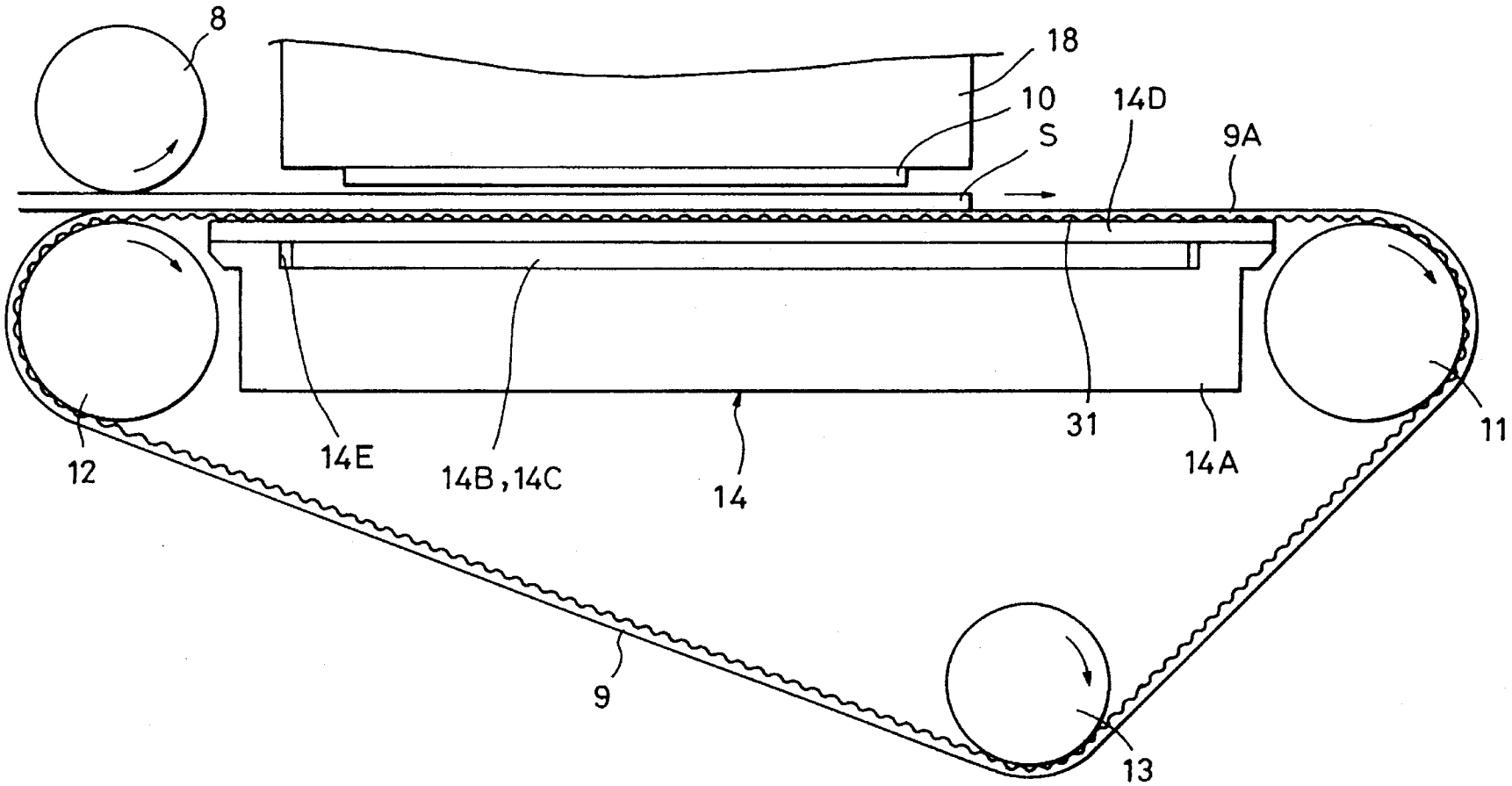
FIG. 5 is a schematic longitudinal sectional side view of the overall construction of a sheet transport apparatus in accordance with a second embodiment of the present invention.

FIG. 5 shows the overall construction of a sheet transport apparatus in accordance with the second embodiment of the present invention.

In this sheet transport apparatus, a fine roughness pattern 31 having a peak or trough pitch of several microns to several tens of microns is formed on the inner surface of the transport belt 9 in contact with the electrode protection member 14D. The configuration of this fine roughness pattern 31 and the method of forming this pattern are the same as in the case of the fine roughness pattern 30 of the first embodiment of the present invention.

The fine roughness pattern 30 may be formed on the electrode protection member 14D in addition to the fine roughness pattern 31 formed on the transport belt 9.

Figure 6:
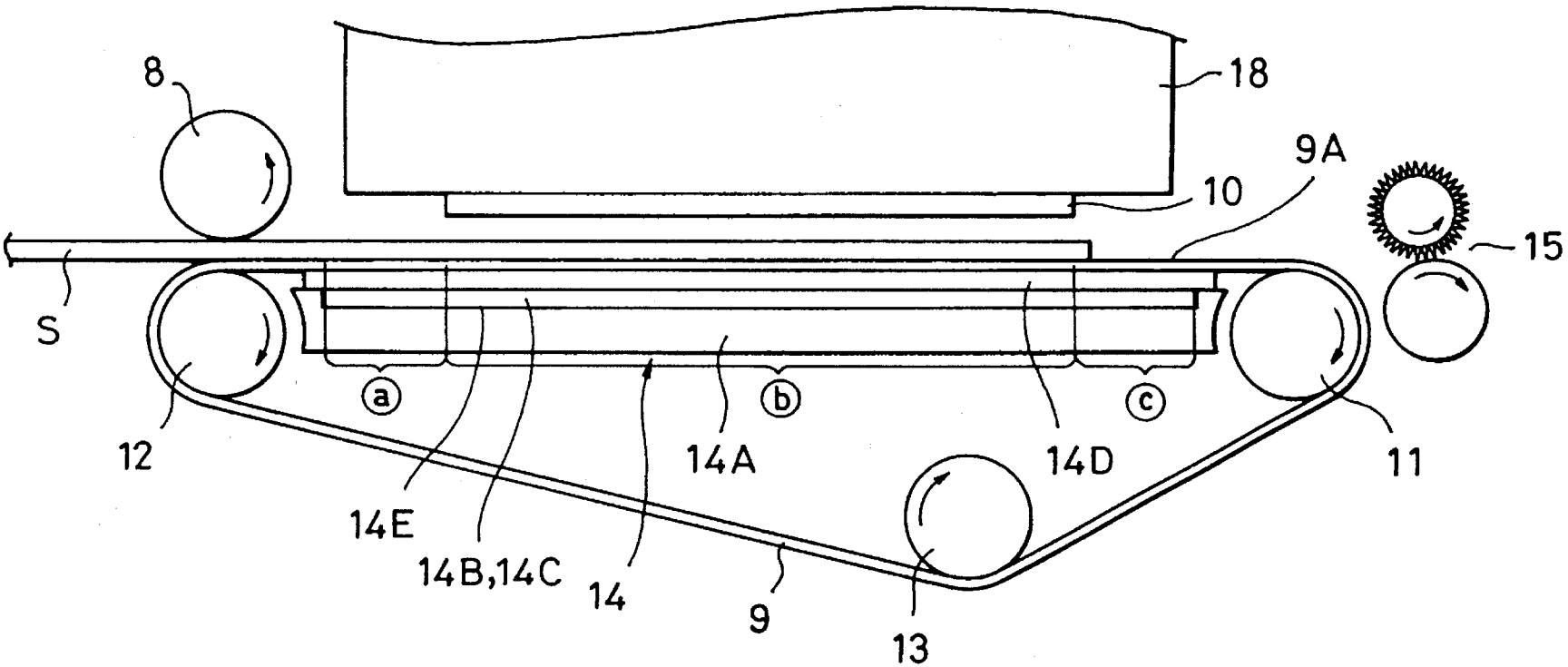
FIG. 6 is a schematic longitudinal sectional side view of the overall construction of a sheet transport apparatus in accordance with a third embodiment of the present invention.
Figure 7:
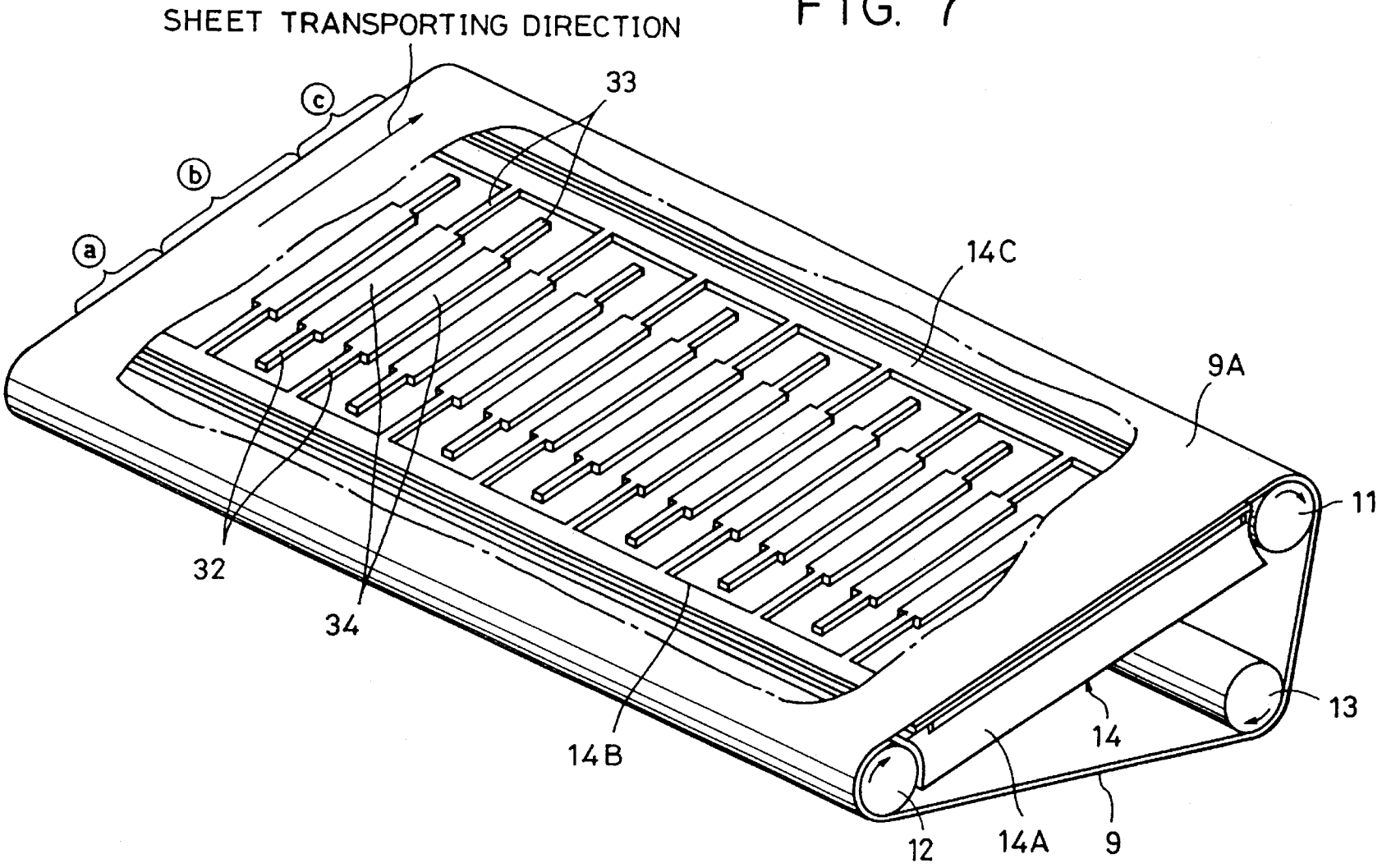
FIG. 7 is a partially-cutaway perspective view of the overall construction of the sheet transport apparatus shown in FIG. 6.

FIGS. 6 and 7 show the overall construction of a sheet transport apparatus in accordance with the third embodiment of the present invention.

In this sheet transport apparatus, to vary the electrostatic attraction force, which is proportional to the electrode area, portions 32 and 33 (electrostatic attraction force reduction means) of the comb-like electrode plate 14B and the comb-like earth plate 14C corresponding to the upstream region a and the downstream region c (particular portions), respectively, are formed so as to be smaller in width and in area than portions 34 corresponding to the printing region b (other portion).

The electrostatic attraction forces generated at the upstream and downstream regions a and c are thereby reduced relative to the electrostatic attraction force generated at the printing region b.

The electrostatic attraction force generated at the printing region b is set to a magnitude such that the sheet member S can closely contact the transport belt without causing any printing failure, while each of the electrostatic attraction forces generated at the upstream and downstream regions a and c is set to a magnitude large enough to prevent a slippage or floating of the sheet member S.

Figure 8:
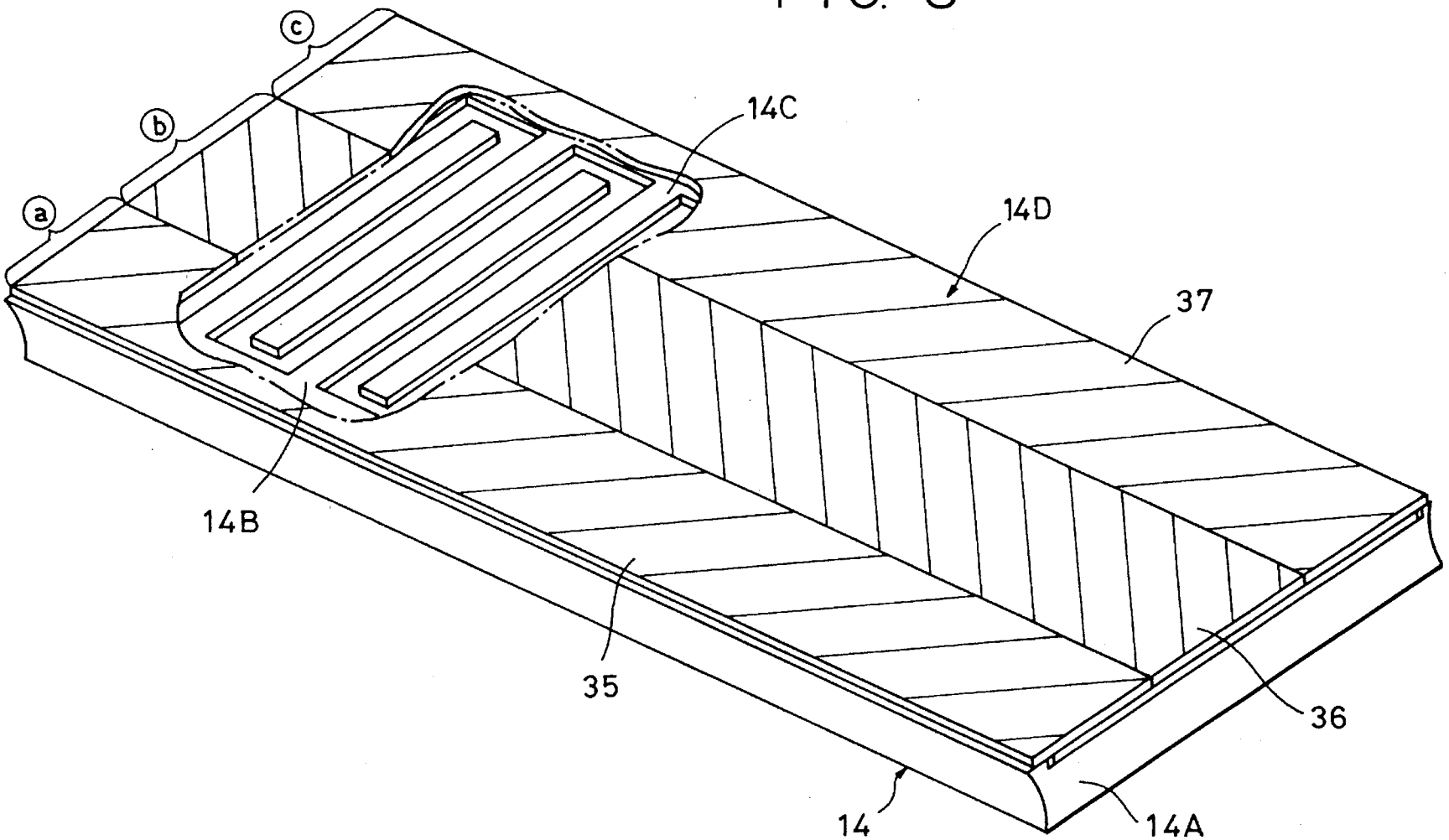
FIG. 8 is a partially-cutaway perspective view of the overall construction of a belt charging unit provided in a sheet transport apparatus in accordance with a fourth embodiment of the present invention.

FIG. 8 shows the overall construction of an electrostatic attraction force generation unit provided in a sheet transport apparatus in accordance with the fourth embodiment of the present invention.

In this sheet transport apparatus, the electrode protection member 14D is formed of a part 35 corresponding to the upstream area a, a part 36 corresponding to the printing area b and a part 37 corresponding to the downstream area c. The volume resistivity of the part 36 corresponding to the printing area b is reduced relative to those of the parts 35 and 37 corresponding to the upstream and downstream regions a and c (particular portions).

The electrostatic attraction forces generated at the upstream and downstream regions a and c are thereby reduced relative to the electrostatic attraction force generated at the printing region b.

In this embodiment, the electrode protection member 14D is divided into three parts 35, 36 and 37 differing in volume resistivity. Alternatively, the volume resistivity of one electrode protection member 14D may be varied with respect to portions corresponding to the regions a, b, and c.

Figure 9:
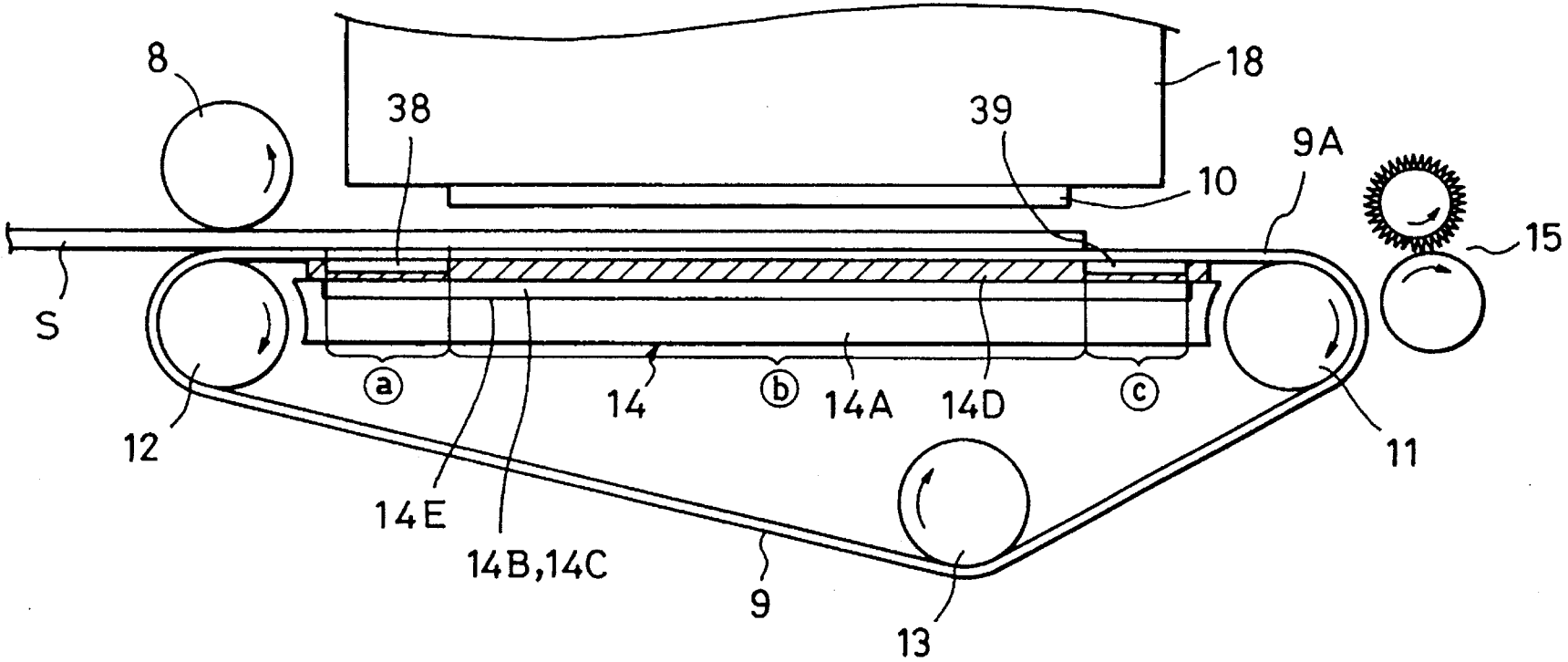
FIG. 9 is a schematic longitudinal sectional side view of the overall construction of a sheet transport apparatus in accordance with a fifth embodiment of the present invention.

FIG. 9 shows the overall construction of a sheet transport apparatus in accordance with the fifth embodiment of the present invention.

In this sheet transport apparatus, recesses 38 and 39 (electrostatic attraction force reduction means) are formed in the upper surface portions of the electrode protection member 14D corresponding to the upstream and downstream regions a and c (particular portions). The recesses 38 and 39 form air layers.

The electrostatic attraction forces generated at the upstream and downstream regions a and c are thereby reduced relative to the electrostatic attraction force generated at the printing region b.

Figure 10:
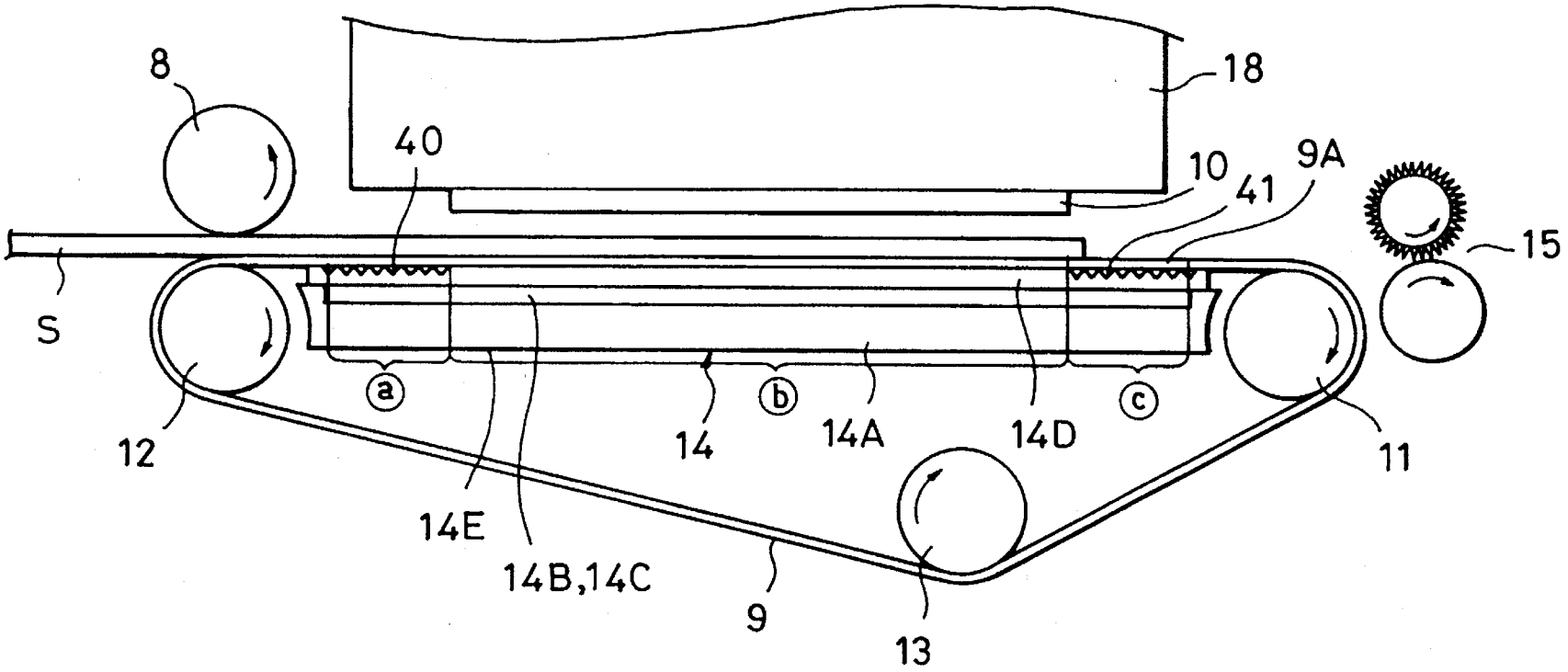
FIG. 10 is a schematic longitudinal sectional side view of the overall construction of a sheet transport apparatus in accordance with a sixth embodiment of the present invention.

FIG. 10 shows the overall construction of a sheet transport apparatus in accordance with the sixth embodiment of the present invention.

In this sheet transport apparatus, fine roughness patterns 40 and 41 (electrostatic attraction force reduction means) having a peak or trough pitch of several microns to several tens of microns are formed in the entire upper surface portions of the electrode protection member 14D corresponding to the upstream and downstream regions a and c (particular portions). The configuration of these fine roughness patterns 40 and 41 and the method of forming these patterns are the same as in the case of the fine roughness pattern 30 of the first embodiment of the present invention.

The electrostatic attraction forces generated at the upstream and downstream regions a and c are thereby reduced relative to the electrostatic attraction force generated at the printing region b.

Figure 11:
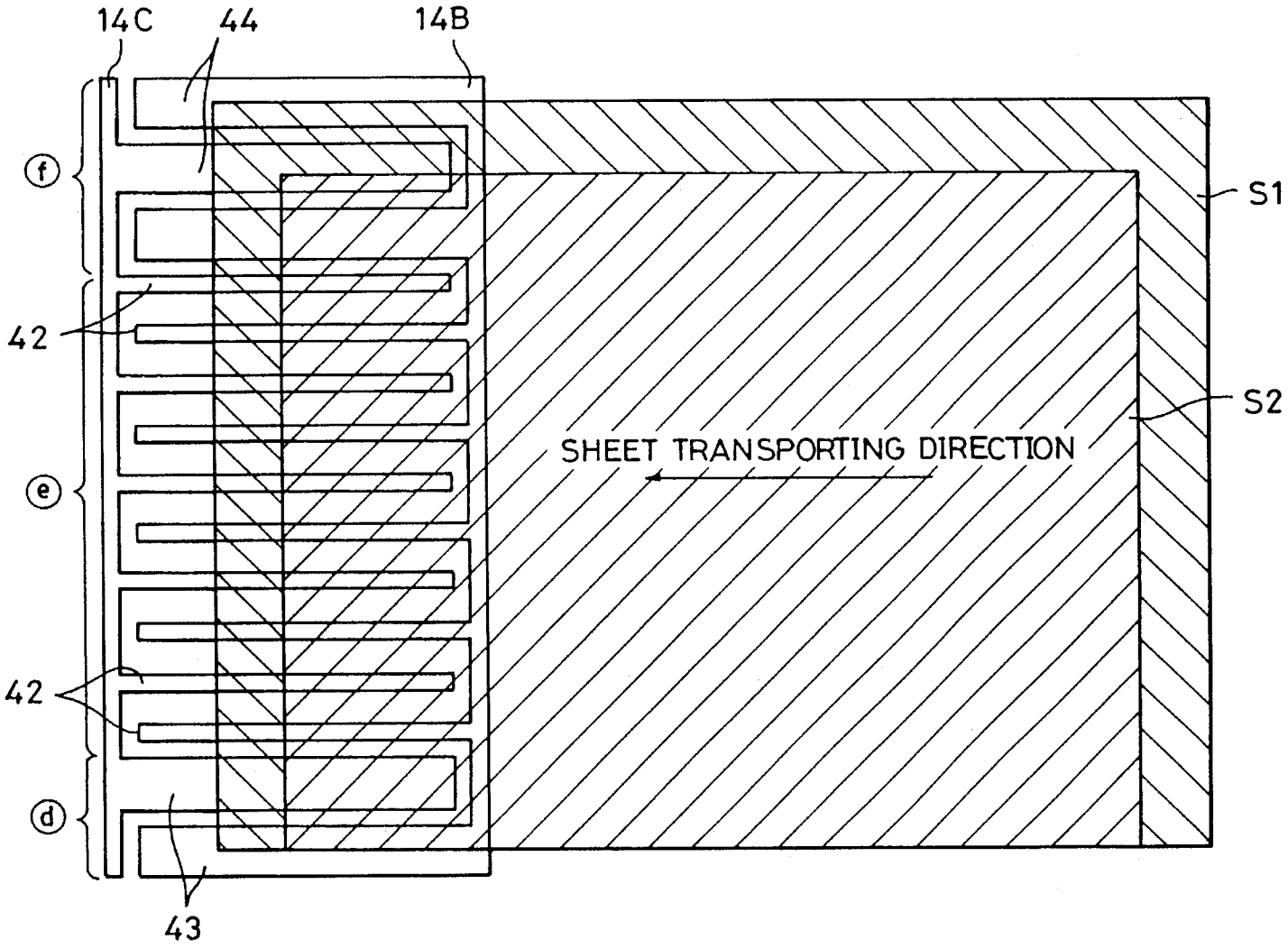
FIG. 11 is a schematic plan view of an essential portion of a belt charging unit provided in a sheet transport apparatus in accordance with a seventh embodiment of the present invention.
Figure 12:
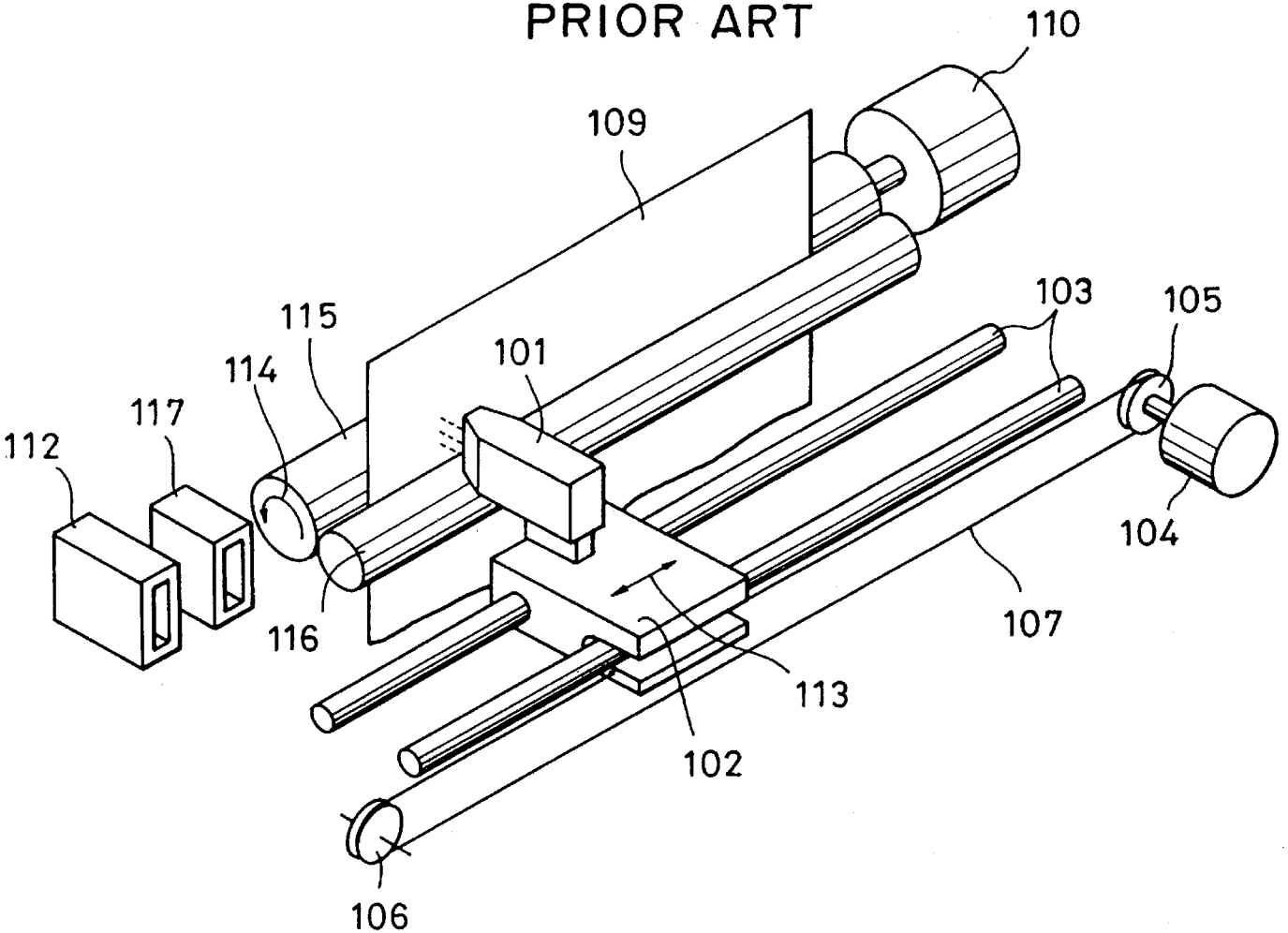
FIG. 12 PRIOR ART
FIG. 12 is a perspective view of essential components of a conventional ink jet recording apparatus.
Figure 13:
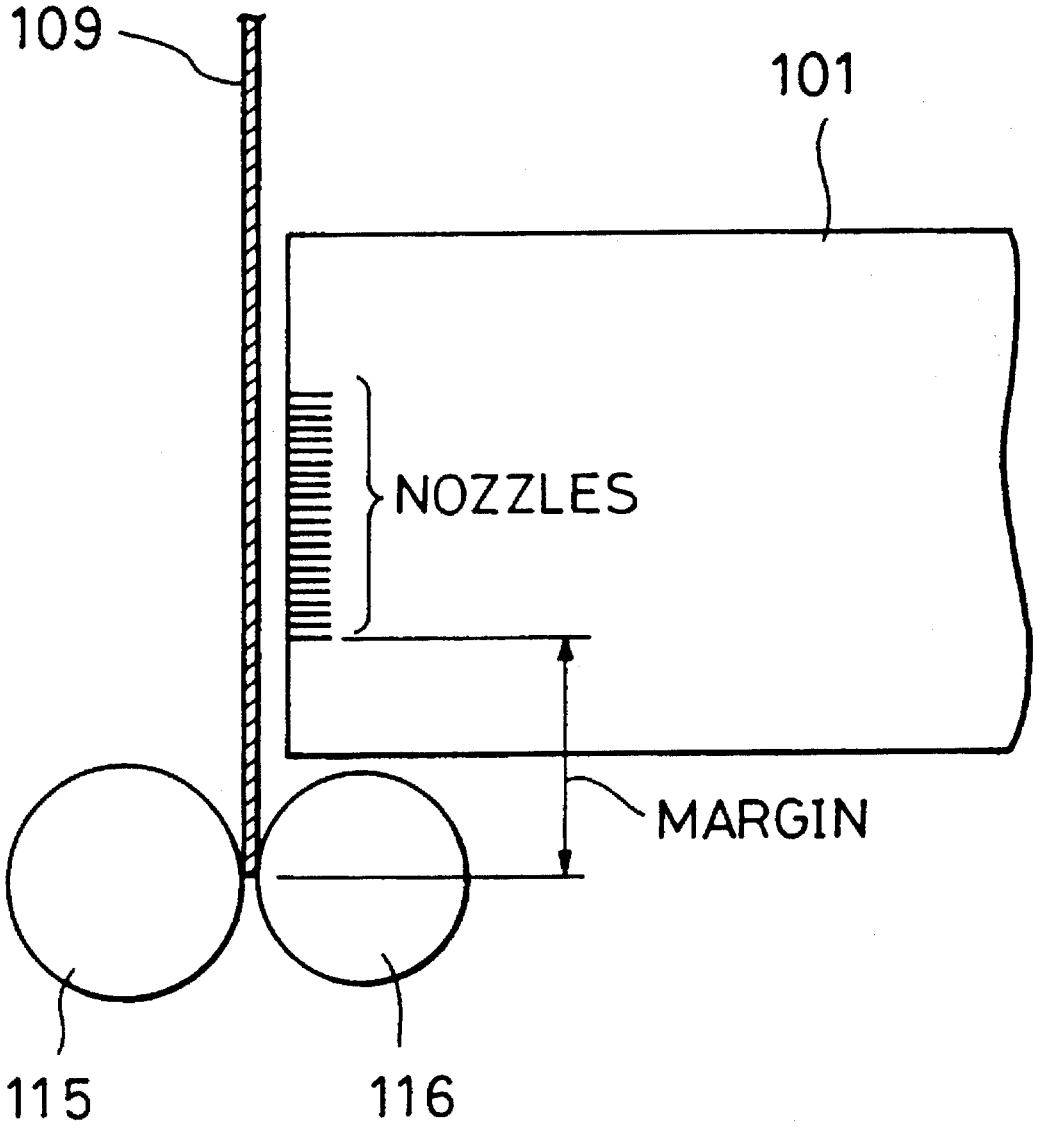
FIG. 13 PRIOR ART
FIG. 13 is a diagram showing a margin on a recording medium in the conventional recording apparatus.

FIG. 11 shows the construction of an essential portion of an electrostatic attraction force generation unit provided in a sheet transport apparatus in accordance with the seventh embodiment.

Portions 42 (electrostatic attraction force reduction means) of the comb-like electrode plate 14B and the comb-like earth plate 14C corresponding to a sheet center passage region e (particular portion) along which a central portion of the sheet member passes are formed so as to be smaller in width and in area than portions 43 and 44 corresponding to sheet end passage regions d and f (other portion) along which left and right end portions of the sheet member pass.

In FIG. 11, a symbol S1 designates an A4 size sheet member while a symbol S2 designates an A5 size sheet member.

The electrostatic attraction force generated at the sheet center passage region e of the transport belt is thereby reduced relative to the electrostatic attraction forces generated at the sheet end passage regions d and f.

In this embodiment, the electrostatic attraction force at the sheet center passage region e of the transport belt is reduced while the electrostatic attraction forces at the sheet end passage regions d and f are substantially large. This arrangement may be adopted in combination with any of the arrangements of the second, third and fourth embodiments.

In the ink jet head used in accordance with the above-described embodiments, heating elements are provided in the nozzles for ejecting ink. A bubble is formed in ink by thermal energy generated by each heating element, and an ink droplet is jetted through the nozzle by the expansion of the bubble.

In the sheet transport apparatus of the present invention, as described above, the area of contact between the transport belt and the belt charging means electrostatically attracted to each other is reduced as well as the adherence therebetween, thereby achieving a reduction in the drive load on the transport belt caused by the electrostatic attraction.

Also, a region of a small electrostatic attraction force is provided between the transport belt and the belt charging means electrostatically attracted to each other, thereby also achieving a reduction in the drive load on the transport belt caused by the electrostatic attraction.

The individual components shown in outline in the drawings are all well-known in the image recording and sheet transporting arts and their specific construction and operation are not critical to the operation or best mode for carrying out the invention.

While the present invention has been described with respect to what are currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet transport apparatus comprising:

a transport belt for transporting a sheet member, said transport belt having a first surface and a second surface opposite the first surface, the sheet member contacting the first surface; and electrostatic attraction force generation means for generating an electrostatic force for attracting the sheet member to the first surface of said transport belt, said electrostatic attraction force generation means being disposed adjacent the second surface of said transport belt;

wherein at least one of a surface of said electrostatic attraction force generation means contacting said transport belt and the second surface of said transport belt is roughened.

2. An apparatus according to claim 1, wherein said electrostatic attraction force generation means comprises a plurality of elongated electrodes, with each electrode extending along a transporting direction in which said transport belt moves.

3. An apparatus according to claim 2, wherein said plurality of electrodes are arranged with a predetermined pitch along a widthwise direction of said transport belt, the widthwise direction being orthogonal to the transporting direction.

4. An apparatus according to claim 3, wherein said electrodes are connected to each other at their ends on one side to form a comb-like configuration.

5. An apparatus according to claim 4, wherein said electrostatic attraction force generation means comprises earth members disposed between said electrodes.

6. An apparatus according to claim 5, wherein said earth members are elongated along the transporting direction in which said transport moves and are connected to each other at ends on one side to form a comb-like configuration.

7. An apparatus according to claim 5, wherein said electrostatic attraction force generation means further comprises an electrode protection member for covering electrodes and said earth members.

8. An apparatus according to claim 7, wherein said electrode protection member comprises a sheet-like member.

9. An apparatus according to claim 7, wherein a surface of said electrodes protection member facing said transport belt is roughened.

10. An apparatus according to claim 1, wherein said roughened surface has a peak or trough pitch of several microns to several tens of microns.

11. An apparatus according to claim 1, further comprising recording means for recording on the sheet member, wherein said recording means is disposed at a position opposite to a position at which said transport belt contacts the sheet member.

12. An apparatus according to claim 11, wherein said recording means ejects ink for recording on the sheet member.

13. An apparatus according to claim 12, wherein said recording means forms an image with ink droplets which are formed by thermal energy.

14. A sheet transport apparatus comprising:

a transport belt for transporting a sheet member, said transport belt having a first surface and a second surface opposite the first surface, the sheet member contacting the first surface; and electrostatic attraction force generation means for generating an electrostatic force for attracting the sheet member to the first surface of said transport belt, said electrostatic attraction force generation means being disposed adjacent the second surface of said transport belt;

wherein an electrostatic attraction force generated at at least one portion of said transport belt by said electrostatic attraction force generation means is smaller than an electrostatic attraction force generated at another portion of said transport belt.

15. An apparatus according to claim 14, wherein said electrostatic attraction force generation means comprises a plurality of elongated electrodes, with each electrode extending along a transporting direction in which said transport belt moves.

16. An apparatus according to claim 15, wherein a surface area of said electrodes corresponding to the one portion of said transport belt is less than a surface area of said electrodes corresponding to the other portion of said transport belt to reduce the electrostatic attraction force generated at said particular portion.

17. An apparatus according to claim 14, wherein said electrostatic attraction force generation means further comprises an electrode protection member for covering said electrodes.

18. An apparatus according to claim 17, wherein an air chamber is provided in a portion of said electrode protection member between said electrodes and said transport belt, the air chamber corresponding to the one portion of said transport belt, whereby the electrostatic attraction force generated at the one portion is reduced.

19. An apparatus according to claim 17, wherein a volume resistivity of a portion of said electrode protection member corresponding to the one portion of said transport belt is increased to reduce the electrostatic attraction force generated at the one portion.

20. An apparatus according to claim 17, wherein a surface of a portion of said electrode protection member corresponding to the one portion of said transport belt and contacting said transport belt is roughened to reduce the electrostatic attraction force generated at the one portion.

21. An apparatus according to claim 14, further comprising recording means for recording on the sheet member, wherein said recording means is disposed at a position opposite to a position at which said transport belt contacts the sheet member.

22. An apparatus according to claim 21, wherein said recording means ejects ink for recording on the sheet member.

23. An apparatus according to claim 22, wherein said recording means forms an image with ink droplets which are formed by thermal energy.

24. An apparatus according to claim 21, wherein said recording means records at a position other than a position corresponding to the one portion of said transport belt.

25. A sheet transport apparatus comprising:

a transport belt for transporting a sheet member, the transport belt having an inner surface and an outer surface and the sheet member contacting the outer surface;

electrostatic attraction force generation means for generating an electrostatic force for attracting the sheet member to the outer surface of said transport belt, said electrostatic attraction force generation means being disposed adjacent the inner surface of said transport belt; and reducing means for reducing a load between the inner surface of said transport belt and said electrostatic attraction force generation means.

26. A sheet transport apparatus according to claim 25, wherein said reducing means comprises a roughened portion on the inner surface of said transport belt.

27. A sheet transport apparatus according to claim 25, wherein said reducing means comprises a toughened portion on a surface of said electrostatic attraction force generation means.

28. A sheet transport apparatus according to claim 27, wherein said electrostatic attraction force generation means comprises electrodes and a sheet-like electrode protection member and the roughened surface is provided on said sheet-like electrode protection member.

29. A sheet transport apparatus according to claim 25, wherein said reducing means comprises means for reducing the electrostatic force at at least one portion of said transport belt.

30. A sheet transport apparatus according to claim 29, wherein said electrostatic attraction force generation means comprises a plurality of elongated electrodes extending in a transporting direction in which said transport belt moves.

31. A sheet transport apparatus according to claim 30, wherein said reducing means comprises a portion of said electrodes having a surface area smaller than a surface area of a remaining portion of said electrodes.

32. A sheet transport apparatus according to claim 30, wherein a sheet-like electrode protection member is provided between said electrodes and the inner surface of said transport belt.

33. A sheet transport apparatus according to claim 32, wherein said reducing means comprises an air chamber formed in said protection member.

34. A sheet transport apparatus according to claim 32, wherein said reducing means comprises a portion of said protection member that has an increased volume resistivity.

* * * * *